US006736694B2

(12) United States Patent
Hornsby et al.

(10) Patent No.: US 6,736,694 B2
(45) Date of Patent: May 18, 2004

(54) AMUSEMENT DEVICE

(75) Inventors: James R. Hornsby, St. Louis, MO (US); Marcellus R. Benson, St. Louis, MO (US); Joseph L. McGowan, St. Charles, MO (US); Arne A. Schmidt, Ballwin, MO (US); William H. Bronson, Jr., St. Louis, MO (US)

(73) Assignee: All Season Toys, Inc., Malibu, CA (US)

( * ) Notice: Subject to any disclaimer, the term of this patent is extended or adjusted under 35 U.S.C. 154(b) by 388 days.

(21) Appl. No.: 09/777,016

(22) Filed: Feb. 5, 2001

(65) Prior Publication Data

US 2001/0029147 A1 Oct. 11, 2001

Related U.S. Application Data

(60) Provisional application No. 60/180,359, filed on Feb. 4, 2000.

(51) Int. Cl.[7] ..... A63H 7/00; B25J 5/00

(52) U.S. Cl. ..... 446/356; 446/357; 318/568.12

(58) Field of Search ..... 446/175, 297, 446/268, 397, 342, 343, 313, 352–357, 376–377; 434/307 R, 308, 323; 463/1, 30, 36, 39, 40, 42, 46; 318/560, 568.1, 568.11, 568.12, 568.2; 273/148 R, 148 B

(56) References Cited

U.S. PATENT DOCUMENTS 4,840,602 A * 6/1989 Rose
4,846,693 A * 7/1989 Baer
4,857,030 A * 8/1989 Rose
5,746,602 A * 5/1998 Kikinis
6,089,942 A * 7/2000 Chan
6,149,490 A * 11/2000 Hampton et al.
6,160,540 A * 12/2000 Fishkin et al.
6,358,111 B1 * 3/2002 Fong et al.

OTHER PUBLICATIONS

'Your Guide to the Latest Mechano–Mutts' by Emily Jenkins, Wired Magazine (www.wired.com/archive/8.09/mutts_pr.html), Sep. 2000, 3 pages.*

'Aibo, Poo–Chi, and Other Robot Dogs' by M. Stark, (www.cs.umd.edu/~mstark/furby/Essays/aibo.html), undated, 5 pages.*

Trendmasters News Release (www.trendmasters.com/trendmastersnews/bigscratchlilscratch.html), 3 pages.*

* cited by examiner

*Primary Examiner*—Mark Sager
(74) *Attorney, Agent, or Firm*—Dorsey & Whitney LLP

(57) ABSTRACT

The present invention provides an interactive amusement device and system encompassing a primary robotic unit which performs actions communicated by a remote wireless transmitter and at least one secondary robotic unit which interacts through wireless communication with the primary robotic unit. In some embodiments, the primary and secondary robotic units interact with each other and the user.

46 Claims, 6 Drawing Sheets

AMUSEMENT DEVICE

CROSS-REFERENCE TO RELATED APPLICATION

Applicant claims priority from U.S. Provisional Application No. 60/180,359 filed Feb. 4, 2000.

BACKGROUND OF THE INVENTION

The present invention relates to toys and amusement devices and, in one embodiment, an electro-mechanical interactive amusement device comprising two elements interactive with each other, wherein, in one embodiment, the elements communicate with each other, and in one embodiment, one element follows and/or takes commands and/or inputs the other. In some embodiments, the two elements may appear to be, for example, parent dog and a puppy which each may be interactive with a user and each other.

Remotely controlled interactive toys are well-known in the art. Toys can be remotely controlled by sonic (including voice), infra-red, and other signals. Toy vehicles controlled by radio signals are well-known and typically comprise a vehicle that has an electric drive motor and a radio receiver that responds to radio signals from a hand-held controller/transmitter. In this way, a user can remotely move the vehicle backwards or forwards and steer it in any direction.

Interactive dolls have ranged from a doll that closes its eyes when it is placed in a horizontal "sleeping" position to a computer-controlled interactive doll that receives commands from a personal computer via wireless transmissions. In use, typical interactive dolls act in a predetermined fashion based on the stimulus provided by the user. Increased interactivity increases the interest level for the user.

Notwithstanding currently available remote-controlled and interactive devices, there is a need for an inexpensive, easy-to-use, interactive remote-controlled device that enhances user interest and enjoyment. Children are usually fascinated with animals, so it would be advantageous if there were an interactive toy with robotic, pet-like qualities. Presently, interactive toys consist almost entirely of dolls and remote-control vehicles. The few available robotic pets are complicated, expensive, and require cumbersome headsets or waist-packs.

There is also a need for a mother-child, father-child, senior-junior, old-young, or large-small pair of interactive, remote-controlled toys. Since increased realism evokes greater interest, the realistic interaction of a seemingly older pet-like toy with a seemingly younger one would increase the user's interest.

SUMMARY OF THE INVENTION

The present invention provides an inexpensive robotic, pet-like interactive amusement device and system that is easy to use. In some embodiments, the invention further provides a senior-junior or large-small pair of interactive devices, wherein one device is larger than the other.

In one embodiment, the present invention provides an interactive amusement device comprising a robotic dog.

The present invention provides an interactive amusement device and system encompassing a primary robotic unit which performs actions communicated by a remote wireless transmitter and at least one secondary robotic unit which interacts through wireless communication with the primary robotic unit. In some embodiments, the primary and secondary robotic units interact with each other and the user.

In another embodiment, the present invention provides an interactive amusement device comprising a body including a motor, at least two leg elements, a microprocessor, a wireless receiver, and a unit wireless transmitter. The invention further comprises a remote wireless transmitter operably coupled by wireless communication with the wireless receiver. The motor is operably coupled to the at least two leg elements, which are moveably connected to the body. The wireless receiver is operably coupled to the microprocessor, which is operably coupled to the motor. The unit wireless transmitter is capable of wireless communication with a second interactive amusement device.

The remote wireless transmitter may be adapted to be handheld. The invention may further comprise a touch plate operably coupled to the microprocessor. The embodiment may further comprise a head element moveably connected to the body, wherein the motor is operably coupled to the head element. It may also further comprise at least one ear element moveably connected to the head element, wherein the motor is operably coupled to the at least one ear element. In addition, the embodiment may comprise eyes moveably connected to the head element, wherein the motor is operably coupled to the eyes.

The present embodiment may comprise a mouth element moveably connected to the head element, wherein the motor is operably coupled to the mouth element. The embodiment may further comprise a speaker associated with the body, wherein the microprocessor is operably coupled to the speaker. It may comprise a tail element moveably connected to the body, wherein the motor is operably coupled to the tail element. It may further comprise an exterior creature element slideably associated with an exterior of the body, wherein the exterior creature is removeable by one of the at least two leg elements.

In another embodiment, the present invention provides an interactive amusement system comprising a primary unit, at least one secondary unit, and a remote wireless transmitter. The primary unit has a first body with at least two first leg elements moveably connected, a first motor operably coupled to the at least two first leg elements, and a first microprocessor operably coupled to the first motor. The primary unit further has a first wireless receiver operably coupled to the first microprocessor and a first unit wireless transmitter associated with the first body.

The at least one secondary unit has a second body with at least two second leg elements moveably connected, a second motor operably coupled to the at least two second leg elements, and a second microprocessor operably coupled to the second motor. The at least one secondary unit further has a second wireless receiver operably coupled to the second microprocessor. The first unit wireless transmitter is operably coupled by wireless communication with the second wireless receiver. The at least one secondary unit also has a second unit wireless transmitter operably coupled by wireless communication to the primary unit or another secondary unit.

The remote wireless transmitter is operably coupled by wireless communication to the first wireless receiver and the second wireless receiver. It may be adapted to be handheld.

The primary unit of the system embodiment may further comprise a first touch plate operably coupled to the first microprocessor. The primary unit may further comprise a first head element moveably connected to the body, wherein the first motor is operably coupled to the head element. It may also further comprise at least one first ear element moveably connected to the first head element, wherein the first motor is operably coupled to the at least one first ear element. In addition, the embodiment may comprise at least one first eye moveably connected to the first head element, wherein the first motor is operably coupled to the at least one first eye element.

The primary unit of the present embodiment may further comprise a first mouth element moveably connected to the first head element, wherein the first motor is operably coupled to the first mouth element. The embodiment may further comprise a first speaker associated with the first body, wherein the first microprocessor is operably coupled to the first speaker. It may comprise a first tail element moveably connected to the first body, wherein the first motor is operably coupled to the first tail element. It may further comprise a first exterior creature element slideably associated with an exterior of the first body, wherein the first exterior creature element is removeable by one of the at least two first leg elements.

The at least one secondary unit of the system embodiment may further comprise a second touch plate operably coupled to the second microprocessor. The at least one secondary unit may further comprise a second head element moveably connected to the second body, wherein the second motor is operably coupled to the second head element. It may also further comprise at least one second ear element moveably connected to the second head element, wherein the second motor is operably coupled to the at least one second ear element. In addition, the embodiment may comprise at least one second eye moveably connected to the second head element, wherein the second motor is operably coupled to the at least one second eye element.

The at least one secondary unit of the present embodiment may further comprise a second mouth element moveably connected to the second head element, wherein the second motor is operably coupled to the second mouth element. The embodiment may further comprise a second speaker associated with the second body, wherein the first microprocessor is operably coupled to the second speaker. It may comprise a second tail element moveably connected to the second body, wherein the second motor is operably coupled to the second tail element. It may further comprise a second exterior creature element slideably associated with an exterior of the second body, wherein the second exterior creature element is removeable by one of the at least two second leg elements.

Another embodiment of the present invention provides an interactive amusement system comprising a remote wireless transmitter, a primary robotic unit, and at least one secondary robotic unit. The remote wireless transmitter is adapted to transmit a first wireless communication.

The primary robotic unit has a first wireless receiver adapted to receive the first wireless communication. The primary robotic unit further has a first microprocessing unit adapted to process the first wireless communication and command the primary robotic unit to perform an action. The primary robotic unit also has a first wireless transmitter adapted to transmit a second wireless communication. The first wireless transmitter is operably controlled by the first microprocessing unit.

The at least one secondary robotic unit is interactive with the primary robotic unit. The at least one secondary robotic unit has a second wireless receiver adapted to receive the second wireless communication. It further has a second microprocessing unit adapted to process the second wireless communication and command the at least one secondary robotic unit to perform a requested action.

The at least one secondary robotic unit may further comprise a second wireless transmitter adapted to transmit a third wireless communication. The second wireless transmitter may be operably controlled by the second microprocessing unit. The first wireless receiver may be further adapted to receive the third wireless communication. The first microprocessing unit, in addition, may be further adapted to process the third wireless communication. The second wireless receiver may also be further adapted to receive the first wireless communication. The second microprocessing unit, therefore, may be further adapted to process the first wireless communication.

The interactive device of the present invention provides and encompasses a method for controlling operation of the device. One embodiment of the present invention provides a method of operating an interactive amusement system comprising the steps of (1) transmitting a first wireless communication from a remote wireless transmitter to a first unit, (2) the first unit performing at least one first action, the at least one first action requested by the first wireless communication, (3) transmitting a second wireless communication from a first unit wireless transmitter associated with the first unit to at least one second unit, and (4) the at least one second unit performing at least one second action, the at least one second action requested by the second wireless communication.

The remote wireless transmitter of the embodiment may be adapted to be handheld. The step of transmitting a first wireless communication may be further adapted to be transmitted to the at least one second unit, the at least one second unit performing at least one second action. The embodiment may further comprise the step of transmitting a third wireless communication from a second unit wireless transmitter associated with the at least one second unit to the first unit. The first unit will perform at least one first action.

In some embodiments, operational or functional aspects of the amusement device of the present invention may be controlled by a microprocessor or computer, including one or more suitable printed circuit boards.

Other features and advantages of the amusement device and method of the present invention will become more fully apparent and understood with reference to the following description and drawings.

DETAILED DESCRIPTION

Figure 1:
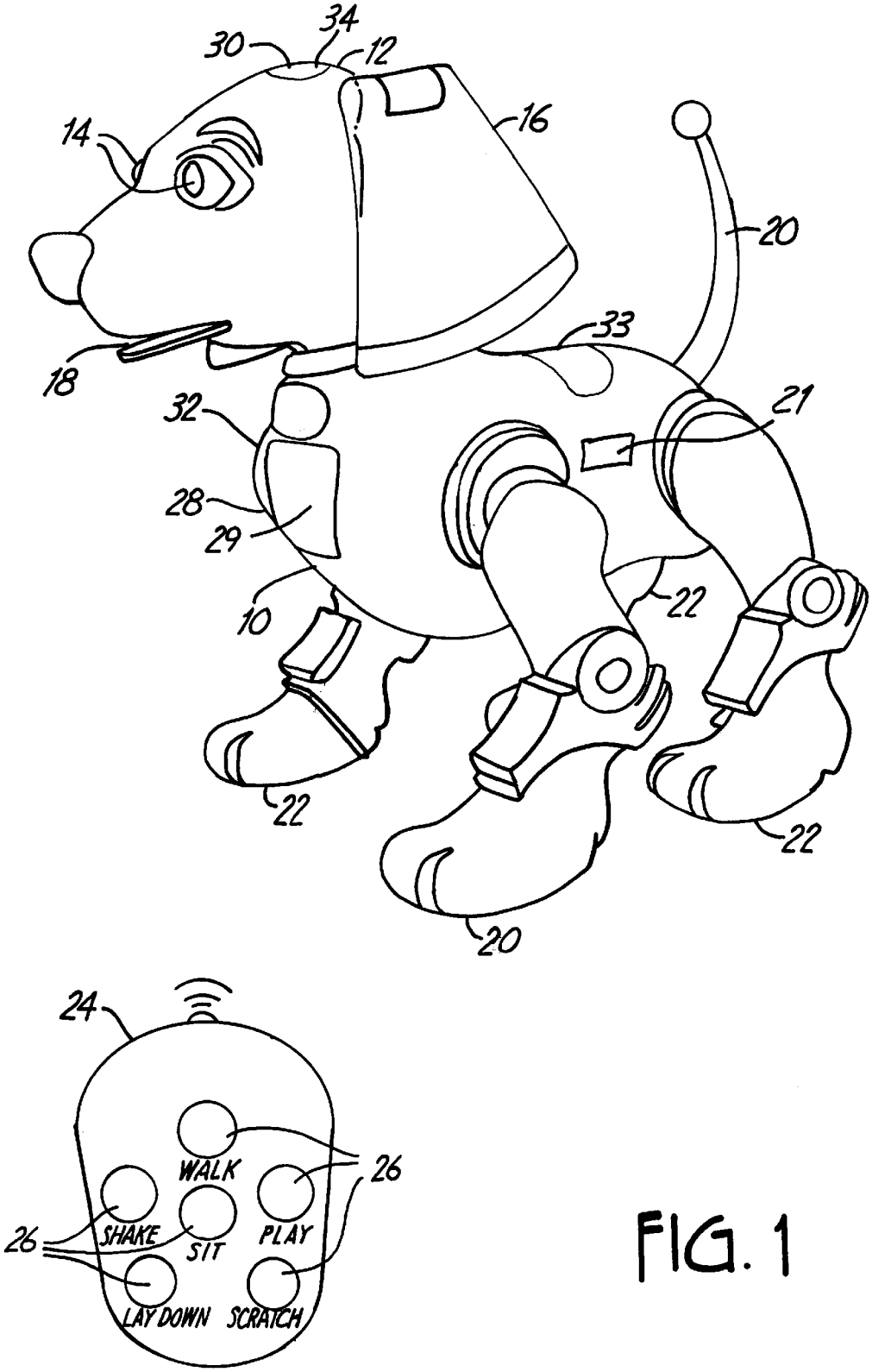
FIG. 1 is an elevational perspective view of one embodiment of the amusement device of the present invention, namely, a senior/large robotic dog.

Features and advantages of the amusement device apparatus and method of the present invention will become more fully apparent and understood with reference to the above-referenced drawings, this description and the appended claims, including embodiments of an interactive amusement device (which also may be referred to as a toy), and features and components thereof, and the description of the method or process by which the toy interacts with a user or another toy.

With regard to fastening, mounting, attaching or connecting the components of the present invention to form the device or apparatus as a whole, unless specifically described otherwise, the invention may incorporate or use conventional fasteners such as screws, nut and bolt connectors, machined connectors, snap rings, clamps such as screw clamps and the like, rivets, nuts and bolts, toggles, pins and the like. Components may also be connected by adhesives, sewing, welding, friction fitting or deformation, if appropriate. Electrical features and functions may be accomplished by using suitable electrical devices, including motors, speakers, sensors, inputs, outputs, printed circuits, pc boards, chips and the like, and electrical connections may be made using appropriate electrical components and connection methods, including available components, connectors and connecting methods. Mechanical and mechanical operational features may be accomplished by using suitable mechanical devices, including motors, cams, links and linkages, drive trains, gears, shafts, pins and the like. Unless specifically otherwise disclosed or taught, materials for making components of the present invention are selected from appropriate materials such as metal, metallic alloys, fibers, fabrics, plastics and the like, natural or synthetic, and appropriate manufacturing or production methods including casting, extruding, weaving, spinning, molding and machining may be used.

Any references to front and back, right and left, top and bottom and upper and lower are intended for convenience of description, not to limit the present invention or its components to any one positional or spacial orientation.

As used herein, the terms "mother," "father" and/or "parent" are intended to encompass a mother or father creature, figure or character, an older creature (such as a dog), figure or character, or older clone or twin creature, figure or character, and the term "puppy" or "baby" is intended to encompass an offspring creature, figure or character, a younger and/or smaller creature, figure or character, or a younger and/or smaller clone or twin creature, figure or character. The subject creature, figure or character of the present invention, in one embodiment, a dog and puppy, may be generally representative of reality, i.e., animal, human and the like, or may be entirely imaginary or whimsical. The invention is intended to encompass "robot" or "robotic" type devices comprising mechanisms for performing tasks, including mechanisms guided or operated by controls, including automatic controls, so that they appear to function or operate of their own volition or to be animated.

Although the microprocessor or controller, or microprocessors, for the present invention can be any digital controller or microprocessor-based system, and more than one may be involved, in one embodiment of the invention, the controller comprises a suitable processing unit and suitable peripheral devices. A suitable peripheral device may be a field programmable micro-controller peripheral device that includes programmable logic devices, EPROMs, and input-output ports. Typically, instructions are stored in the controller as program logic, which might be found as RAM or ROM hardware in the peripheral device. (Since the processing unit may have some memory capacity, it is possible that some of the instructions are stored in the processing unit.) As one skilled in the art will recognize, various implementations of program logic are possible. The program logic could be either hardware, software, or a combination of both. Hardware implementations might involve hardwired controller logic or instructions stored in a ROM or RAM device. Software implementations would involve instructions stored on a magnetic, optical, or other media that can be accessed by the processing unit. Communication implementations may be wired, optical or wireless.

Referring to FIG. 1, the device and system of the present invention comprises an interactive, robotic, pet-like amusement device, such as a dog 10. As used herein, robot or robotic is intended to encompass devices which give the appearance of animation and/or act of their own volition and/or according to inputs received from a user or the environment.

One embodiment of the robotic dog 10 has features substantially similar to an actual dog, including a body 11 carrying a moveable head 12, which can move at least from side-to-side. The eyes 14 can move in a lifelike fashion. The ears 16 move in a hanging, flapping motion and are disposed downward from the top of the head 12 with a large beagle-like shape. In other embodiments, the ears may be positioned in an upright, pointed Doberman-like disposition, and may be actuated to make twitching motions. The described motions are intended to be exemplary. The mouth 18 can simulate barking and other mouth actions. In other embodiments, the mouth 18 may comprise two or more parts which move in a coordinated fashion to simulate other mouth actions, including but not limited to, eating, licking, or snarling. The tail 20 is positioned upward from the rear portion of the invention 10, and moves in a wagging motion. The tail may also be positioned in a downward hanging position behind the rear portion of the present embodiment. The dog 10 has four legs 22. It can walk by moving each positionable leg 22 in combination with the other three positionable legs 22. The legs 22 can be positioned to make it possible for the robotic toy 10 to walk forward, backward, left, and right. The positionable legs 22 can also be positioned to allow the embodiment to perform other actions including, but not limited to, shaking, sitting, scratching, and laying down. The scratching action can include removing an exterior creature element 21 from the exterior of the dog's body 11. In some embodiments, the legs 22 may be positionable independently or in pairs.

The embodiment of FIG. 1 responds to and performs actions upon commands or inputs or, in some embodiments, upon stimuli from the environment such as loud noises. Such may be communicated to the dog 10 by wireless communications. In one embodiment, a handheld wireless transmitter 24 typically transmits an infrared signal corresponding to the appropriate command button 26 available on the face of the transmitter 24. In some embodiments, the buttons 26 include, but are not limited to, "shake", "lay down", "sit", "scratch", "walk", and "play." An appropriate infrared signal corresponding to a command is received by the wireless receivers 28, 30 located on the robotic unit 10. In the embodiment of FIG. 1, one wireless receiver 28 is associated with the circuit board 29 behind a transparent panel 32 on the front of the robotic unit 10. Another wireless receiver 30 is located in a transparent touch plate 34 on top of the head 12. The present embodiment performs a specific action pursuant to a specific command. The actions include but are not limited to: walking, sitting, laying down, shaking, scratching, or playing. Walking encompasses walking forward, backward, left, or right. The "playing" action may be a single, predetermined action or it may be picked randomly from the actions including, but not limited to, walking, sitting, laying down, shaking, or scratching.

Another embodiment performs both a "walk left" and a "walk right" action rather than the single "walk" action. By these actions, the robotic unit 10 may turn to the right or to the left. By alternating the commands to actuate the device 10 to walk right and then walk left, the device 10 can be made to move in a generally straight direction. Accordingly, the handheld transmitter 24 includes command buttons for "walk left" and "walk right" rather than "walk".

Figure 2:
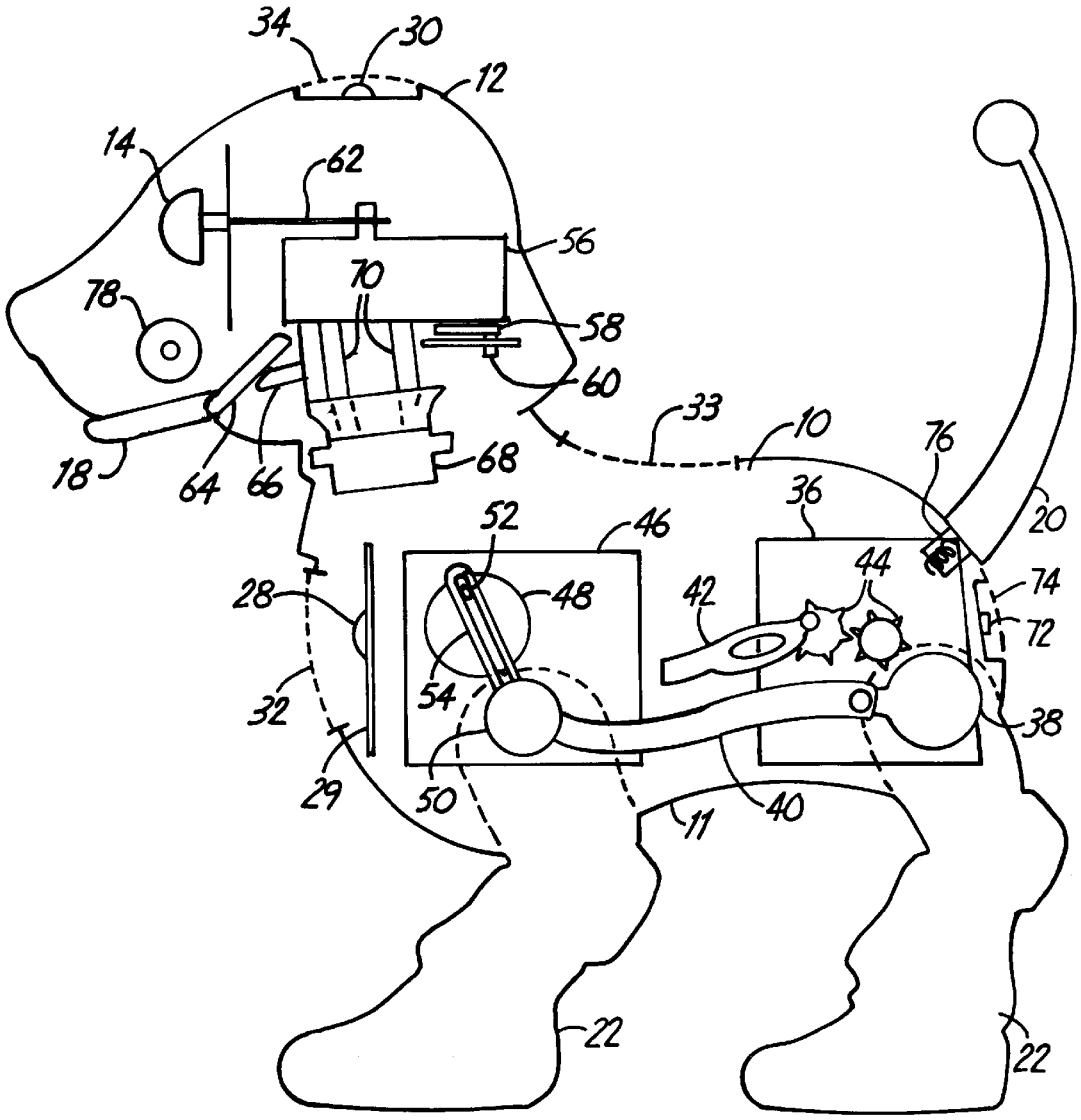
FIG. 2 is an elevational side view of one embodiment of the senior/large robotic dog of the present invention, with portions in section and/or broken away to show internal and/or operational features.

FIG. 2 depicts one embodiment wherein the wireless receiver 28 associated with the circuit board 29 is behind the transparent panel 32, and the wireless receiver 30 is found in the transparent touch plate 34 on the head 12. These receivers 28, 30 transfer signals received from the handheld wireless transmitter 24 to the circuit board 29. The circuit board 29 then transmits the appropriate command to the rear motor 36, the front motor 46, the head motor 56, or a speaker 78 (see FIG. 3 for suitable locations for the motors 36, 46, 56 and the speaker 78).

The embodiment may have a wireless transmitter 72 located behind a rear transparent panel 74 in a rear portion of the present embodiment of the invention 10. The transmitter 72 may be used to transmit signals to another similar robotic toy, a different toy, or back to the handheld transmitter 24.

In other embodiments, the receivers or transmitters may be positioned in other suitable locations on the invention 10, including but not limited to: in the eyes 14, behind a transparent panel 33 on the back portion of the invention 10, or in the tail 20.

The circuit board 29 receives further signals from the touch plate 34. When the touch plate 34 is depressed by a user, an electronic signal is transmitted to the circuit board 29. The circuit board 29 then transmits the appropriate command to the rear motor 36, the front motor 46, the head motor 56, or a speaker 78. In one embodiment, the signal transmitted by the touch plate 34 is processed by the circuit board 29 and transmitted as a single, predetermined command to the appropriate motor 36, 46, 56 or speaker 78. In other embodiments, the signal transmitted by the depressed touch plate 34 causes the circuit board 29 to randomly select an action. The randomly-selected action may include, but is not limited to, walking a short distance, sitting, laying down, shaking, scratching, or playing.

The embodiment depicted in FIG. 2 comprises three motors, although, as is true of receivers and transmitters, any number and type of suitable motors or actuators may be used. The rear motor 36 operably drives and controls the rear legs 22 through a rear axle 38. The rear axle also aids the operable control of the front legs through a connection lever 40. Another lever element 42 actuated by a series of gears 44 connected to the rear axle 38 may be used for further leg control, balance, and other action control. The front motor 46 operably drives and controls the front legs 22 with a drive disc 48, which actuates the front axle 50 through the use of a crank arm 52 slideably connected to a radial lever 54 extending from the front axle 50.

Referring to FIG. 2, the head motor 56 comprises a rotating disc 58 with a crank arm 60 inserted into a stationary slot element 62, which is attached to the main structure of the head 12. By turning the crank arm 60 inside a stationary slot element 62, the entire head motor 56, which is moveably attached to the head 12, moves in a pivoting, circular motion. Through its pivoting motion, the head motor actuates three parts of the present embodiment. The eyes are moved by an eye motion lever 62, which is slideably connected to the head motor 56 and attached to the eyes 14. The pivoting or turning motion of the head motor 56 is translated by the eye motion lever 62 into lifelike movement of the eyes 14. The head motor 56 causes the mouth 18 to move by moving an attached tongue piece 64 with an actuation lever 66. The head motor 56 moves the entire head 12 by the actuation of a collar piece 68. The motion of the head motor 56 is translated to the collar piece 68 by two connection rods 70. When the collar piece moves in a pivoting motion, the entire head 12 of the embodiment moves.

The tail 20 depicted in FIG. 2 is connected with the main portion of the invention 10 with a spring joint 76 that allows and/or causes the tail 20 to move in a wag-like motion when the robotic dog 10 is moving.

The embodiment of FIG. 2 also includes a speaker 78 located in the head 12 near the mouth 18. The circuit board 29 is operably connected to the speaker 78. The speaker 78 is utilized to create sounds including, but not limited to, barking, grunting, panting, and other related dog-like noises.

In other embodiments, controllable, moveable elements such as the head 12, the eyes 14, the mouth 18, the ears 16, the tail 20 and the legs 22, may be operably controlled independently of each other. For example, a motor specifically directed to and connected only with the eyes 14 may be suitably located in the invention 10 for controlling eye movements.

Figure 3:
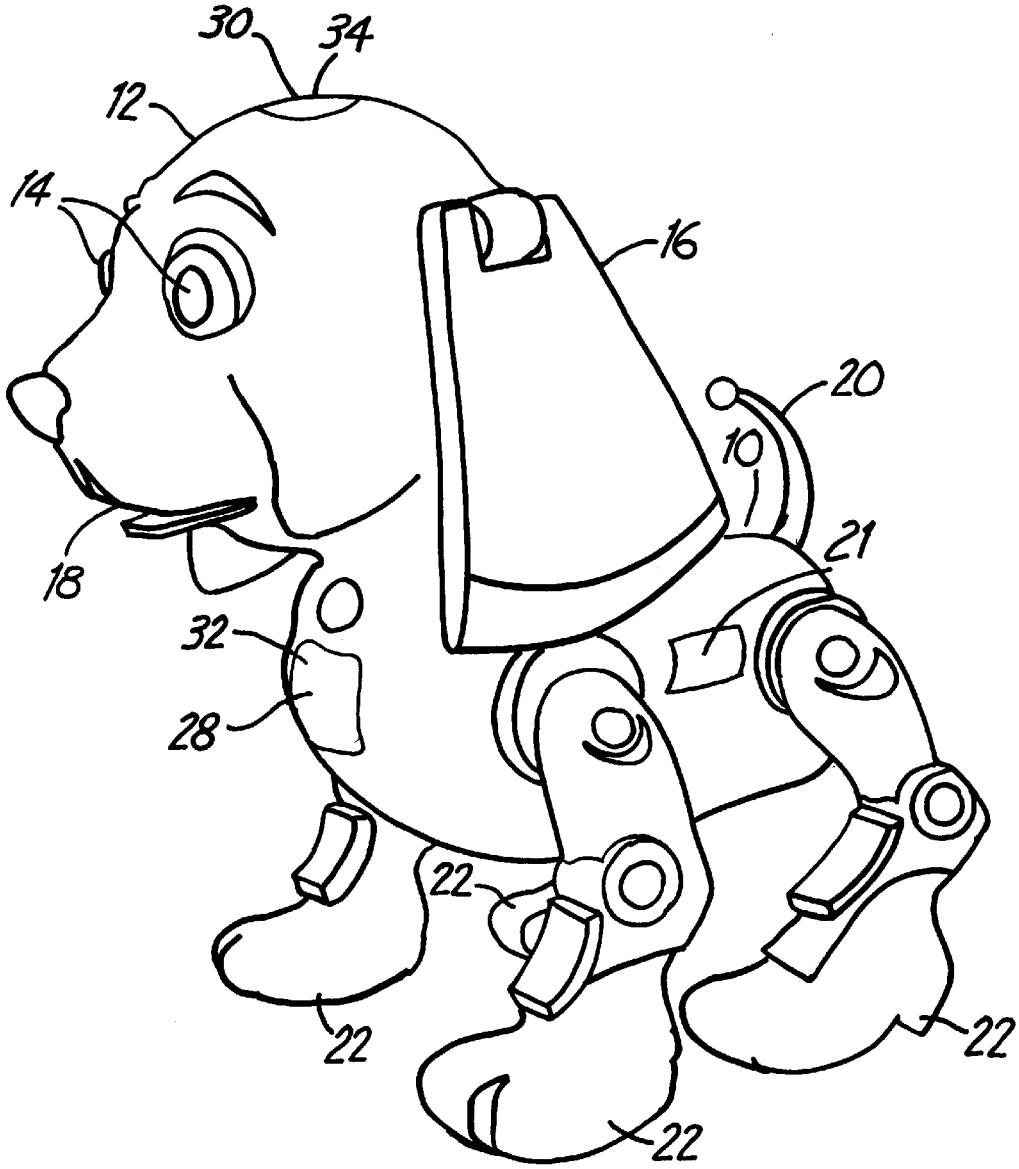
FIG. 3 is an elevational perspective view of one embodiment of the amusement device of the present invention, namely, a junior/small robotic dog or puppy.

One embodiment of the junior/smaller version of the amusement device of the present invention is depicted in FIG. 3. The junior/smaller version comprises many of the same elements as the senior/larger version of FIG. 1, and common or similar elements will be commonly numbered. The junior versions includes a body 11 carrying a head 12 with operable eyes 14, a moveable mouth 18, a touch plate 34, and beagle-like ears 16. The embodiment also has a tail 20, a wireless receiver 28 behind a transparent panel 32, and moveable legs 22. In some embodiments, these elements are operable in generally the same manner as those of the previous embodiment. According to one embodiment, the junior version includes a removable exterior creature element 21, wherein the element 21 is removable by one of the moveable legs 22. In contrast to the embodiment of FIG. 1, the embodiment depicted in FIG. 3 may be smaller. The embodiment further has a head 12 with features that may be more round, possibly to simulate a "younger" pet than the previous embodiment.

Figure 4:
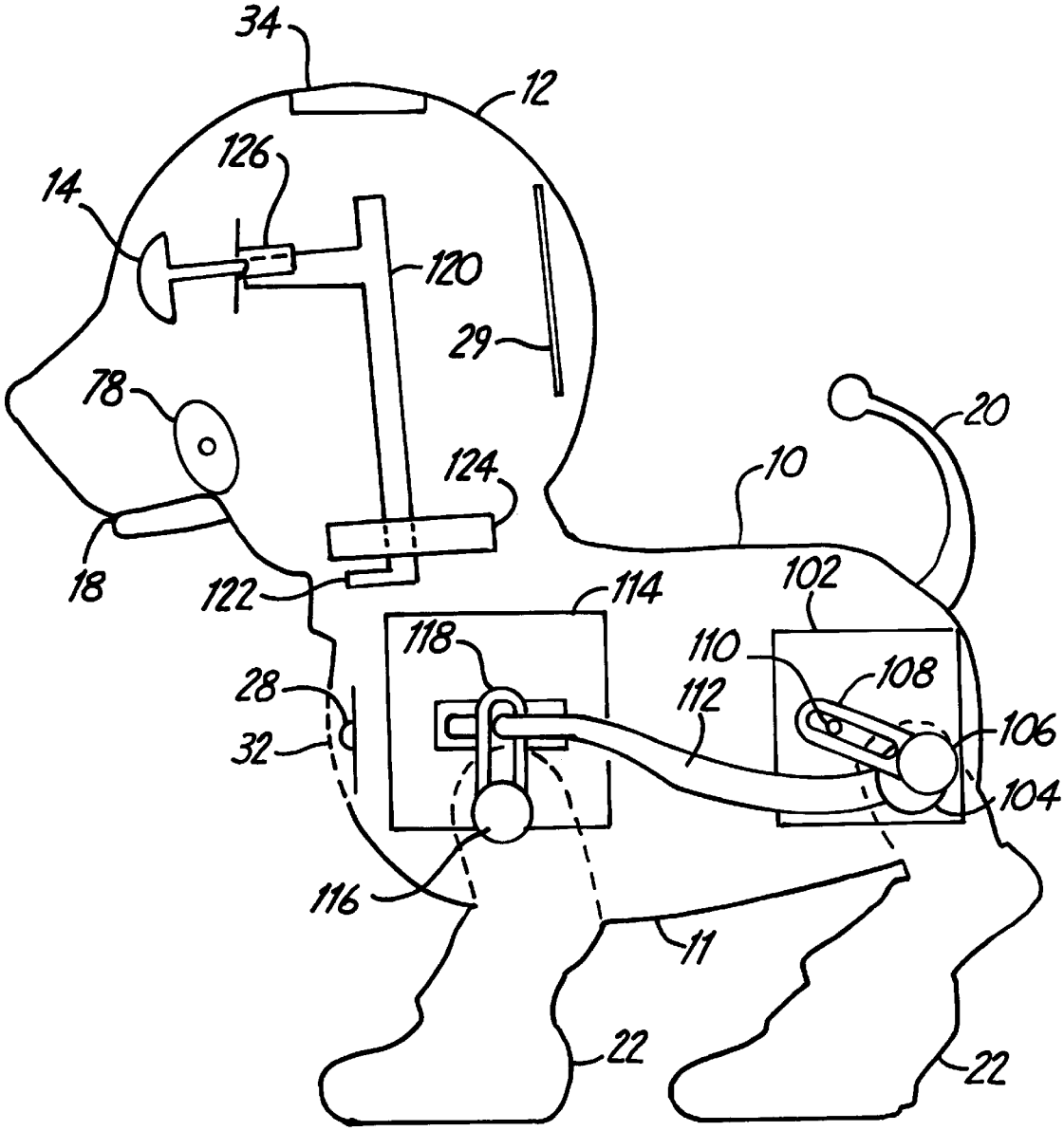
FIG. 4 is an elevational side view of one embodiment of the junior/small robotic dog or puppy of the present invention, with portions in section and/or broken away to show internal and/or operational features.

Another embodiment of the junior/smaller device, shown in profile in FIG. 4, comprises a different internal structure. The head 12 comprises similar elements, including moveable eyes 14, a touch plate 34, a moveable mouth 18, and a speaker 78 internally associated with the mouth 18. The circuit board 29 is also located inside the head 12, while the wireless receiver is located in the front portion of the invention 10, behind a transparent panel 32.

With continued reference to FIG. 4, the device 10 comprises two motors. The rear motor 102 operably controls the rear legs 22 through a rear axle 104. The rear axle contains a crank arm, which is attached to the rear legs 22. The crank arm is guided by a radial lever 108 sliding over a fixed pin 110. The rear axle 104 also aids the operable control of the front legs 22 through a connection lever 112. The front motor 114 operably controls the front legs 22 by actuating a front axle 116, with the aid of the rear motor 102 through the actuation of a crank arm 118 by the connection lever 112.

The eyes 14 are operably controlled by a central actuation pin 120 connected to a catch lever 122 through a neck collar 124. When the head 12 is caused to move in a pivoting fashion at the neck collar 124 as a result of the movement of the device 10, the catch lever 122 catches against the fixed structure of the front portion of the invention 10 below the head 12. The inhibition of the catch lever prevents the central actuation pin 120 from pivoting with the head 12. The movement of the head 12 causes the eye activation lever 126 to contact the central actuation pin 120, causing the eyes 14 to move.

Figure 5:
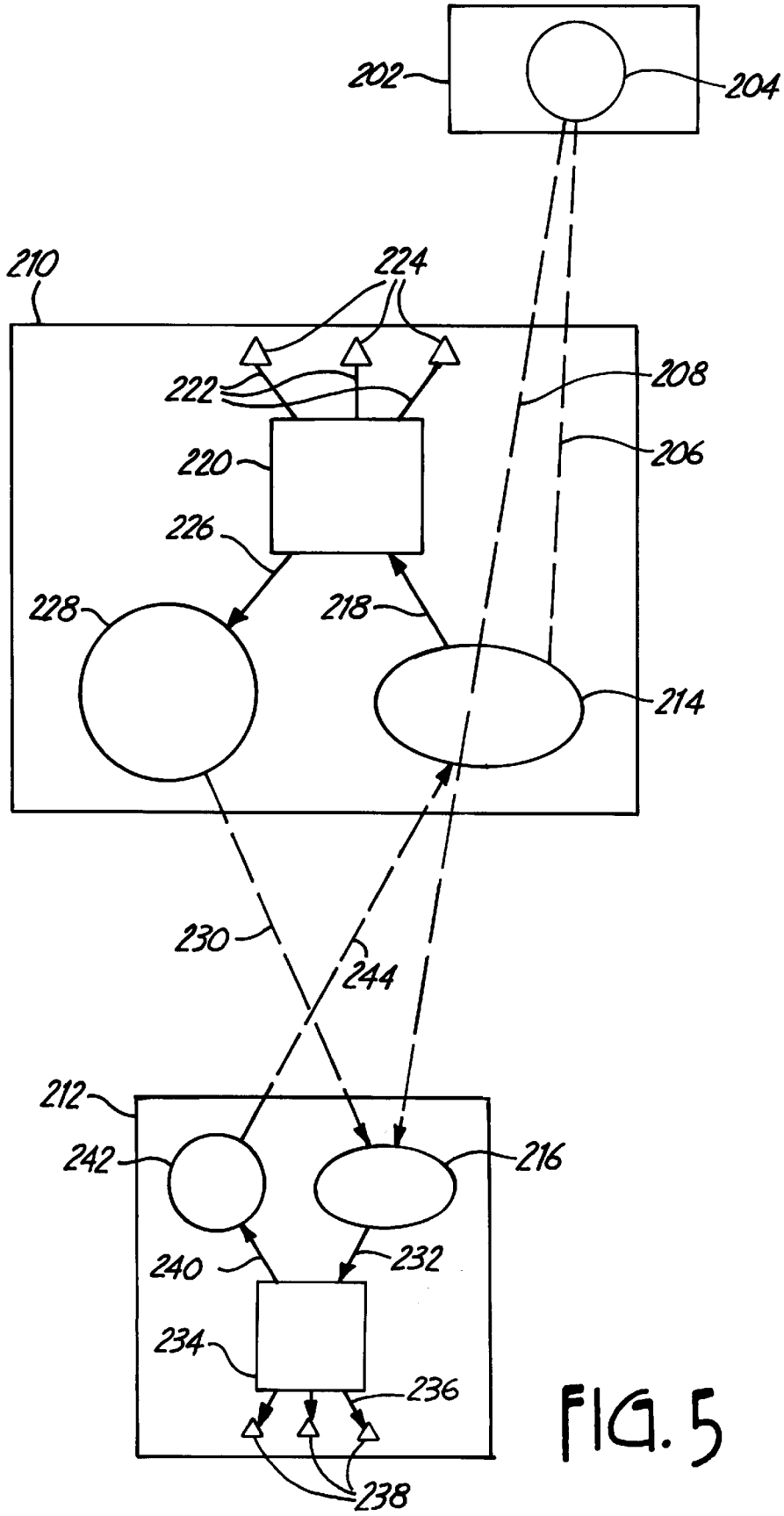
FIG. 5 depicts one embodiment of the amusement system of the present invention.

One embodiment of an input transmitting device 202 for use with the present invention is depicted in FIG. 5. The device 202 is a handheld wireless transmitting device which contains an infrared transmitter 204. The transmitter 204 is capable of sending infrared signals 206, 208 to a primary unit 210 and a secondary unit 212. The primary unit 210 has an infrared receiver 214 capable of receiving the signal 206 from the handheld device 202. The secondary unit 212 also has an infrared receiver 216 capable of receiving the signal 208.

Upon receipt of the infrared signal 206 at the primary unit 210, the receiver 214 transfers the signal 218 to the microprocessor 220 of the primary unit 210. The microprocessor 220 processes the signal 218 and sends the appropriate command 222 related to the signal 218 to the appropriate motor or action element 224. The motor or action element 224 performs the requested action. The requested action may include, but is not restricted to, walking or other leg actions, barking or other sounds, eye movements, ear movements, or tail movements. The microprocessor 220 may also send an appropriate signal 226 to the infrared transmitter 228, which in turn transmits a signal 230 to the receiver 216 of the secondary unit 212.

With continuing reference to FIG. 5, upon receipt of the infrared signal 230 at the secondary unit 212, the receiver 216 of the secondary unit 212 transfers the signal 232 to the microprocessor 234 of the secondary unit 212. The microprocessor 234 processes the signal 232 and sends the appropriate command 236 related to the signal 232 to the appropriate motor or action element 238 of the secondary unit 212. The motor or action element 238 performs the requested action. The requested action may include, but is not restricted to, walking or other leg actions, barking or other sounds, eye movements, ear movements, or tail movements. The microprocessor 234 may also send an appropriate signal 240 to the infrared transmitter 242 of the secondary unit 212, which in turn transmits a signal 244 to the receiver 214 of the primary unit 210.

Figure 6:
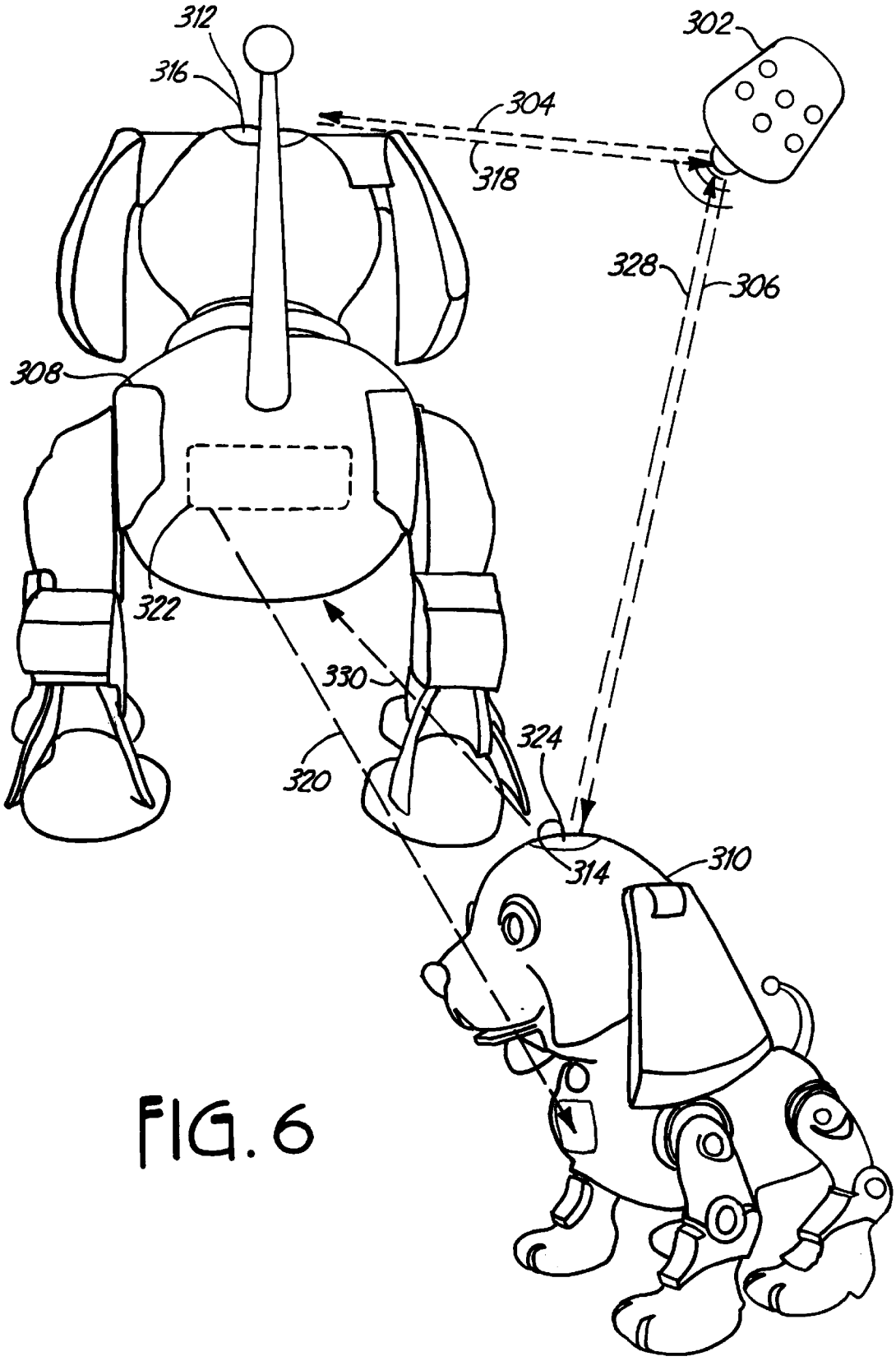
FIG. 6 depicts another embodiment of the amusement system of the present invention, namely a senior/large robotic dog and a junior/small robotic dog or puppy.

FIG. 6 depicts another embodiment of the present invention, comprising interactive robotic dog-like toys. The handheld remote transmitter 302 is capable of sending infrared signals 304, 306 providing action commands to a dog robot 308 and a puppy robot 310. The dog robot 308 has an infrared receiver 312 capable of receiving the signal 304 from the handheld device 302. The puppy robot 310 also has an infrared receiver 314 capable of receiving the signal 306.

With continuing reference to FIG. 6, the dog robot 308 will perform the requested action pursuant to the infrared signal 304. The requested action may include, but is not restricted to, walking or other leg actions, barking or other sounds, eye movements, ear movements, or tail movements. In some embodiments, the infrared signal 304 will cause the dog robot 308 to utilize its own infrared head transmitter 316 or infrared rear transmitter 322 to transmit an infrared signal 318 back to the handheld transmitter 228. The infrared signal 318 may indicate to the transmitter 228 that the requested action has been performed. In other embodiments, the infrared signal 304 will cause the dog robot 308 to transmit an infrared signal 320 from its own infrared head transmitter 316 or infrared rear transmitter 322 to the puppy robot 310. The infrared signal 320 transmitted to the puppy robot 310 may command the puppy robot 310 to perform a requested action.

With continuing reference to FIG. 6, the puppy robot 310 will perform the requested action pursuant to the infrared signal 304 from the handheld transmitter 302 or the infrared signal 320 from the dog robot 308. The requested action may include, but is not restricted to, walking or other leg actions, barking or other sounds, eye movements, ear movements, or tail movements. In some embodiments, the infrared signal 306 from the handheld transmitter 320 or the infrared signal 320 from the dog robot 308 will cause the puppy robot 310 to utilize its own infrared head transmitter 324 or infrared rear transmitter 326 to transmit an infrared signal 328 back to the handheld transmitter 228. The infrared signal 328 may indicate to the transmitter 228 that the requested action has been performed. In other embodiments, the infrared signal 306 from the handheld transmitter 320 or the infrared signal 320 from the dog robot 308 will cause the puppy robot 310 to transmit an infrared signal 330 from its own infrared head transmitter 324 or infrared rear transmitter 326 to the dog robot 308. The infrared signal 330 transmitted to the dog robot 308 may command the dog robot 308 to perform a requested action.

In use, the robotic pet-like device 10 may be actuated by wireless communication. For example, a user might command the robot 10 to perform an action by pressing the appropriate button on the handheld wireless transmitter 24. Alternatively, the user might actuate the device 10 by pressing a touch plate 34. The user may also actuate the device 10 by a sound, such as speaking, clapping, etc. When the embodiment comprises a larger robot and smaller robot, such as a dog robot 308 and puppy robot 310 combination, the puppy robot 310 may be actuated by the dog robot 308. For example, when the user actuates the dog robot 308 with the handheld transmitter 302 to perform a walking action, the dog robot 308 may actuate the puppy robot 310 to follow behind the dog robot 308. Alternatively, the user may actuate the puppy robot 310 directly by wireless communication. For example, the user might actuate the puppy robot 310 by pressing a command button on the handheld transmitter 302, by pressing a touch plate 34, or by an actuating sound.

The embodiments of the amusement device of the present invention include a suitable data and control operating or processing system or systems, typically in the form of a computer or one or more microprocessor boards or chips (for example, integrated circuits or printed circuit boards) contained within the amusement device. See, for example, FIG. 2, reference 29, and FIG. 4, reference 29. These printed circuit boards or chips may be configured as desired and convenient for particular embodiments and functions, and may be constructed and located as suitable for particular embodiments. A plurality of selected inputs (e.g., buttons, gravity sensor/switches, touch sensitive switches, magnetic switches, temperature sensors and/or microphones) may be operably connected to the microprocessor or directly to operational or functional features (e.g., in analog embodiments), as may be a plurality of selected outputs, e.g., motor, light sources and speaker. A reset input (not shown) may also be coupled to the circuit board 29. The circuit board may comprise one chip, or more, and future performance needs and features (e.g., audio enhancements, RAM, etc.) may involve the use of multi-chip sets. A chip or chips may be function specific or two or more functions or operations may be controlled by a single chip.

The circuit board 29 may include a port to allow data to be programmed or downloaded. This allows performance data to be analyzed in various ways using added detail, or by providing integration with data from other devices so that performance problems can be identified and eliminated. In some embodiments, performance requirements, user use, responses, performance and/or skill can be varied or manipulated, recorded and displayed, or downloaded. The board 29 also may have a number of optional sensor interface connections or control input interfaces for sensing of ambient conditions (light or sound sensors) or direct input through the use of inputs (such as buttons, touch sensitive switches or the like).

The processor or controller 29, whatever form it takes, includes software or programming which is used in the operation of the present invention, including the interactive aspects. It should be understood that the particular software used may vary dependent upon, for example, the desired input and output options and/or interactivity, e.g., the movement(s) displayed and the sound(s) produced. There may be modifications to the software and program routines to accomplish changes, or such may be required in connection with the wide variety of performance, functions, characters, activities, movement, displays, actions and sounds available.

The processor 29 includes suitable operational modules for performing a number of data processing function in connection with the selected and preferred operations. One function is receiving user input and translating it into a selected action. Other representative functions include, but are not limited to, producing and/or controlling an audio output, both or selectively in response to a sensed ambient condition or stimulus or in response to user input, producing and/or displaying audio and/or visual inquiries or prompts of the user, sensing functions, and/or displaying actions or movements in response to user inputs.

The present invention may be embodied in other specific forms without departing from the essential spirit or attributes thereof. For example, outputs other than those described herein may be provided, and the figures may take the form of "plush" toys, human or animal figures, or whimsical figures. It is desired that the described embodiments be considered in all respects as illustrative, not restrictive.

What is claimed is:

1. An interactive amusement device comprising:

(a) a body;

(b) at least two leg elements moveably connected to the body;

(c) a motor associated with the body, the motor operably coupled to the at least two leg elements;

(d) a microprocessor operably coupled to the motor;

(e) a wireless receiver operably coupled to the microprocessor;

(f) a unit wireless transmitter associated with the body, the unit wireless transmitter capable of wireless communication with a second interactive amusement device;

(g) a remote wireless transmitter operably coupled by wireless communication with the wireless receiver; and (h) an exterior creature element slideably associated with an exterior of the body, wherein the exterior creature is removeable by one of the at least two leg elements.

2. The interactive amusement device of claim 1 wherein the remote wireless transmitter is adapted to be handheld.

3. The interactive amusement device of claim 1 further comprising a touch plate operably coupled to the microprocessor.

4. The interactive amusement device of claim 1 further comprising a head element moveably connected to the body, wherein the motor is operably coupled to the head element.

5. The interactive amusement device of claim 4 further comprising at least one ear element moveably connected to the head element, wherein the motor is operably coupled to the at least one ear element.

6. The interactive amusement device of claim 4 further comprising at least one eye moveably connected to the head element, wherein the motor is operably coupled to the at least one eye element.

7. The interactive amusement device of claim 4 further comprising a mouth element moveably connected to the head element, wherein the motor is operably coupled to the mouth element.

8. The interactive amusement device of claim 1 further comprising a speaker associated with the body, wherein the microprocessor is operably coupled to the speaker.

9. The interactive amusement device of claim 1 further comprising a tail element moveably connected to the body, wherein the motor is operably coupled to the tail element.

10. A handheld interactive amusement device comprising:

(a) a body;

(b) at least two leg elements moveably connected to the body;

(c) a head element moveably connected to the body;

(d) an at least one ear element moveably connected to the head element;

(e) an at least one eye element moveably connected to the head element;

(f) a mouth element moveably connected to the head element;

(g) a speaker associated with the body;

(h) a tail element moveably connected to the body;

(i) an exterior creature element slideably associated with an exterior of the body, wherein the exterior creature element is removeable by one of the at least two leg elements;

(j) a motor associated with the body, the motor operably coupled to
  (1) the at least two leg elements,
  (2) the head element,
  (3) the at least one ear element,
  (4) the at least one eye element,
  (5) the mouth element, and
  (6) the tail element;

(k) a microprocessor associated with the body, the microprocessor operably coupled to the motor and the speaker;

(l) a wireless receiver operably coupled to the microprocessor;

(m) a touch plate operably coupled to the microprocessor;

(n) a unit wireless transmitter associated with the body, the unit wireless transmitter capable of wireless communication with a second interactive amusement device; and (o) a remote wireless transmitter operably coupled by wireless communication with the wireless receiver.

11. An interactive amusement system comprising:

(a) a primary unit having
  (1) a first body;
  (2) at least two first leg elements moveably connected to the first body;
  (3) a first motor associated with the first body, the first motor operably coupled to the at least two first leg elements;
  (4) a first microprocessor operably coupled to the first motor;
  (5) a first wireless receiver operably coupled to the first microprocessor;
  (6) a first unit wireless transmitter associated with the first body; and
  (7) a first exterior creature element slideably associated with a first exterior of the first body, wherein the first exterior creature is removeable by one of the at least two first leg elements;

(b) at least one secondary unit having
  (1) a second body;
  (2) at least two second leg elements moveably connected to the second body;
  (3) a second motor associated with the second body, the second motor operably coupled to the at least two second leg elements;
  (4) a second microprocessor operably coupled to the second motor;
  (5) a second wireless receiver operably coupled to the second microprocessor, wherein the first unit wireless transmitter is operably coupled by wireless communication with the second wireless receiver; and
  (6) a second unit wireless transmitter associated with the body, the second unit wireless transmitter operably coupled by wireless communication to the primary unit or another secondary unit; and (c) a remote wireless transmitter operably coupled by wireless communication to the first wireless receiver and the second wireless receiver.

12. The interactive amusement device of claim 11, the secondary unit further comprising a second exterior creature element slideably associated with a second exterior of the second body, wherein the second exterior creature is removeable by one of the at least two second leg elements.

13. A handheld interactive amusement system comprising:

(a) a primary unit having
  (1) a first body;
  (2) at least two first leg elements moveably connected to the first body;
  (3) a first head element moveably connected to the first body;
  (4) at least one first ear element moveably connected to the first head element;
  (5) at least one first eye element moveably connected to the first head element;
  (6) a first mouth element moveably connected to the first head element;
  (7) a first speaker associated with the first body;
  (8) a first tail element moveably connected to the first body;
  (9) a first exterior creature element slideably associated with a first exterior of the first body, wherein the first exterior creature element is removeable by one of the at least two first leg elements;
  (10) a first motor associated with the first body, the first motor operably coupled to
    (i) the at least two first leg elements,
    (ii) the first head element,
    (iii) the at least one first ear element,
    (iv) the at least one first eye element,
    (v) the first mouth element, and (vi) the first tail element;
  (11) a first microprocessor operably coupled to the first motor and the first speaker;
  (12) a first wireless receiver operably coupled to the first microprocessor;
  (13) a first touch plate operably coupled to the first microprocessor; and
  (14) a first unit wireless transmitter associated with the first body;

(b) at least one secondary unit having
  (1) a second body;
  (2) at least two second leg elements moveably connected to the second body;
  (3) a second head element moveably connected to the second body;
  (4) at least one second ear element moveably connected to the second head element;
  (5) at least one second eye element moveably connected to the second head element;
  (6) a second mouth element moveably connected to the second head element;
  (7) a second speaker associated with the second body;
  (8) a second tail element moveably connected to the second body;
  (9) a second exterior creature element slideably associated with a second exterior of the second body, wherein the second exterior creature element is removeable by one of the at least two second leg elements;
  (10) a second motor associated with the second body, the second motor operably coupled to
    (i) the at least two second leg elements,
    (ii) the second head element,
    (iii) the at least one second ear element,
    (iv) the at least one second eye element,
    (v) the second mouth element, and
    (vi) the second tail element;
  (11) a second microprocessor operably coupled to the second motor and the second speaker;
  (12) a second wireless receiver operably coupled to the second microprocessor, wherein the first unit wireless transmitter is operably coupled by wireless communication with the second wireless receiver;
  (13) a second touch plate operably coupled to the second microprocessor; and
  (14) a second unit wireless transmitter associated with the body, the second unit wireless transmitter operably coupled by wireless communication to the primary unit or another secondary unit;

(c) a remote wireless transmitter operably coupled by wireless communication to the first wireless receiver and the second wireless receiver.

14. An interactive amusement system comprising:

(a) a remote wireless transmitter adapted to transmit a first wireless communication;

(b) a primary robotic unit having
  (1) a first wireless receiver adapted to receive the first wireless communication;
  (2) a first microprocessing unit adapted to process the first wireless communication and command the primary robotic unit to perform an action;
  (3) a first wireless transmitter adapted to transmit a second wireless communication, the first wireless transmitter operably controlled by the first microprocessing unit; and (4) a first exterior creature element adapted to slideably contact an exterior of the primary robotic unit; and (c) at least one secondary robotic unit interactive with the primary robotic unit, the at least one secondary robotic unit having (1) a second wireless receiver adapted to receive the second wireless communication; and (2) a second microprocessing unit adapted to process the second wireless communication and command the at least one secondary robotic unit to perform a requested action.

15. The interactive amusement system of claim 14, the at least one secondary robotic unit further comprising a second exterior creature element adapted to slideably contact an exterior of the secondary robotic unit.

16. The interactive amusement system of claim 14, the at least one secondary robotic unit further comprising a second wireless transmitter adapted to transmit a third wireless communication, the second wireless transmitter operably controlled by the second microprocessing unit, wherein the first wireless receiver is further adapted to receive the third wireless communication, wherein the first microprocessing unit is further adapted to process the third wireless communication.

17. The interactive amusement system of claim 16, wherein the second wireless receiver is further adapted to receive the first wireless communication, wherein the second microprocessing unit is further adapted to process the first wireless communication.

18. The interactive amusement system of claim 14, wherein the remote wireless transmitter is adapted to be handheld.

19. The interactive amusement system of claim 14, the primary robotic unit further comprising at least two first legs moveably connected to the primary robotic unit, wherein the first microprocessing unit is adapted to command the at least two first legs to perform at least one first leg action.

20. The interactive amusement system of claim 14, the at least one secondary robotic unit further comprising at least two second legs moveably connected to the at least one secondary robotic unit, wherein the second microprocessing unit is adapted to command the at least two second legs to perform at least one second leg action.

21. The interactive amusement system of claim 14, the primary robotic unit further comprising a first touch plate adapted to transmit a first signal upon being depressed, wherein the first microprocessing unit is adapted to process the first signal from the first touch plate.

22. The interactive amusement system of claim 14, the at least one secondary robotic unit further comprising a second touch plate adapted to transmit a second signal upon being depressed, wherein the second microprocessing unit is adapted to process the second signal from the second touch plate.

23. The interactive amusement system of claim 14, the primary robotic unit further comprising a first head element moveably connected to the primary robotic unit, wherein the first microprocessing unit is adapted to command the first head element to perform at least one first head action.

24. The interactive amusement system of claim 23, the primary robotic unit further comprising at least one first ear element moveably connected to the first head element, wherein the first microprocessing unit is adapted to command the at least one first ear element to perform at least one first ear action.

25. The interactive amusement system of claim 23, the primary robotic unit further comprising at least one first eye element moveably connected to the first head element, wherein the first microprocessing unit is adapted to command the at least one first eye element to perform at least one first eye action.

26. The interactive amusement system of claim 23, the primary robotic unit further comprising a first mouth element moveably connected to the first head element, wherein the first microprocessing unit is adapted to command the first mouth element to perform at least one first mouth action.

27. The interactive amusement system of claim 14, the at least one secondary robotic unit further comprising a second head element moveably connected to the at least one secondary robotic unit, wherein the second microprocessing unit is adapted to command the second head element to perform at least one second head action.

28. The interactive amusement system of claim 27, the at least one secondary robotic unit further comprising at least one second ear element moveably connected to the second head element, wherein the second microprocessing unit is adapted to command the at least one second ear element to perform at least one second ear action.

29. The interactive amusement system of claim 27, the at least one secondary robotic unit further comprising at least one second eye element moveably connected to the second head element, wherein the second microprocessing unit is adapted to command the at least one second eye element to perform at least one second eye action.

30. The interactive amusement system of claim 27, the at least one secondary robotic unit further comprising a second mouth element moveably connected to the second head element, wherein the second microprocessing unit is adapted to command the second mouth element to perform at least one second mouth action.

31. The interactive amusement system of claim 14, the primary robotic unit further comprising a first speaker, wherein the first microprocessing unit is adapted to command the first speaker to transmit at least one first transmission.

32. The interactive amusement system of claim 14, the at least one secondary robotic unit further comprising a second speaker, wherein the second microprocessing unit is adapted to command the second speaker to transmit at least one second transmission.

33. The interactive amusement system of claim 14, the primary robotic unit further comprising a first tail element moveably connected to the primary robotic unit, wherein the first microprocessing unit is adapted to command the first tail element to perform at least one first tail action.

34. The interactive amusement system of claim 14, the at least one secondary robotic unit further comprising a second tail element moveably connected to the at least one secondary robotic unit, wherein the second microprocessing unit is adapted to command the second tail element to perform at least one second tail action.

35. An interactive amusement device comprising:

(a) a body;

(b) an appendage element moveably connected to the body;

(c) a motor associated with the body, the motor operably coupled to the appendage element;

(d) a wireless receiver operably coupled to the motor;

(e) a remote wireless transmitter operably coupled by wireless communication with the wireless receiver; and (f) an exterior creature element slideably associated with an exterior of the body, wherein the exterior creature is removeable by the appendage element.

36. The interactive amusement device of claim 35 wherein the remote wireless transmitter is adapted to be handheld.

37. The interactive amusement device of claim 35 further comprising a touch plate operably coupled to the motor.

38. The interactive amusement device of claim 35 further comprising a head element moveably connected to the body, wherein the motor is operably coupled to the head element.

39. The interactive amusement device of claim 38 further comprising at least one ear element moveably connected to the head element, wherein the motor is operably coupled to the at least one ear element.

40. The interactive amusement device of claim 38 further comprising at least one eye moveably connected to the head element, wherein the motor is operably coupled to the at least one eye element.

41. The interactive amusement device of claim 38 further comprising a mouth element moveably connected to the head element, wherein the motor is operably coupled to the mouth element.

42. The interactive amusement device of claim 35 further comprising a tail element moveably connected to the body, wherein the motor is operably coupled to the tail element.

43. An interactive amusement system comprising:

(a) a handheld remote wireless transmitter adapted to transmit a first wireless communication;

(b) a primary robotic unit having (1) a first wireless receiver adapted to receive the first wireless communication;

(2) a first touch plate adapted to transmit a first signal upon being depressed;

(3) at least two first legs moveably connected to the primary robotic unit;

(4) a first head element moveably connected to the primary robotic unit;

(5) at least one first ear element moveably connected to the first head element;

(6) at least one first eye element moveably connected to the first head element;

(7) a first mouth element moveably connected to the first head element;

(8) a first speaker adapted to transmit at least one first transmission;

(9) a first tail element moveably connected to the primary robotic unit;

(10) a first exterior creature element adapted to slideably contact an exterior of the primary robotic unit, wherein the at least two first legs are adapted to remove the first exterior creature element;

(11) a first microprocessing unit adapted to (i) process the first wireless communication or the first signal from the first touch plate, and (ii) command the at least two first legs, the first head element, the at least one first ear element, the at least one first eye element, the first mouth element, the first speaker, or the first tail element to perform an action; and

(12) a first wireless transmitter adapted to transmit a second wireless communication, the first wireless transmitter operably controlled by the first microprocessing unit; and (c) at least one secondary robotic unit interactive with the primary robotic unit, the at least one secondary robotic unit having (1) a second wireless receiver adapted to receive the second wireless communication;

(2) a second touch plate adapted to transmit a second signal upon being depressed;

(3) at least two second legs moveably connected to the at least one secondary robotic unit;

(4) a second head element moveably connected to the at least one secondary robotic unit;

(5) at least one second ear element moveably connected to the second head element;

(6) at least one second eye element moveably connected to the second head element;

(7) a second mouth element moveably connected to the second head element;

(8) a second speaker adapted to transmit at least one second transmission;

(9) a second tail element moveably connected to the at least one secondary robotic unit;

(10) a second exterior creature element adapted to slideably contact an exterior of the at least one secondary robotic unit, wherein the at least two second legs are adapted to remove the second exterior creature element; and

(11) a second microprocessing unit adapted to (i) process the second wireless communication or the second signal from the second touch plate, and (ii) command the at least two second legs, the second head element, the at least one second ear element, the at least one second eye element, the second mouth element, the second speaker, or the second tail element to perform an action.

44. The interactive amusement system of claim 43, the at least one secondary robotic unit further comprising a second wireless transmitter adapted to transmit a third wireless communication, the second wireless transmitter operably controlled by the second microprocessing unit, wherein the first wireless receiver is further adapted to receive the third wireless communication, wherein the first microprocessing unit is further adapted to process the third wireless communication.

45. The interactive amusement system of claim 44, wherein the second wireless receiver is further adapted to receive the first wireless communication, wherein the second microprocessing unit is further adapted to process the first wireless communication.

46. An interactive amusement system comprising:

(a) a handheld remote wireless transmitter adapted to transmit a first wireless communication;

(b) a primary robotic unit having (1) a first wireless receiver adapted to receive the first wireless communication or a second wireless communication;

(2) a first touch plate adapted to transmit a first signal upon being depressed;

(3) at least two first legs moveably connected to the primary robotic unit;

(4) a first head element moveably connected to the primary robotic unit;

(5) at least one first ear element moveably connected to the first head element;

(6) at least one first eye element moveably connected to the first head element;

(7) a first mouth element moveably connected to the first head element;

(8) a first speaker adapted to transmit at least one first transmission;

(9) a first tail element moveably connected to the primary robotic unit;

(10) a first exterior creature element adapted to slideably contact an exterior of the primary robotic unit, wherein the at least two first legs are adapted to remove the first exterior creature element;

(11) a first microprocessing unit adapted to (i) process the first wireless communication, the second wireless communication, or the first signal from the first touch plate, and (ii) command the at least two first legs, the first head element, the at least one first ear element, the at least one first eye element, the first mouth element, the first speaker, or the first tail element to perform an action; and

(12) a first wireless transmitter adapted to transmit a third wireless communication, the first wireless transmitter operably controlled by the first microprocessing unit; and (c) at least one secondary robotic unit interactive with the primary robotic unit, the at least one secondary robotic unit having (1) a second wireless receiver adapted to receive the first wireless communication or the third wireless communication;

(2) a second touch plate adapted to transmit a second signal upon being depressed;

(3) at least two second legs moveably connected to the at least one secondary robotic unit;

(4) a second head element moveably connected to the at least one secondary robotic unit;

(5) at least one second ear element moveably connected to the second head element;

(6) at least one second eye element moveably connected to the second head element;

(7) a second mouth element moveably connected to the second head element;

(8) a second speaker adapted to transmit at least one second transmission;

(9) a second tail element moveably connected to the at least one secondary robotic unit;

(10) a second exterior creature element adapted to slideably contact an exterior of the at least one secondary robotic unit, wherein the at least two second legs are adapted to remove the second exterior creature element;

(11) a second microprocessing unit adapted to (i) process the first wireless communication, the third wireless communication, or the second signal from the second touch plate, and (ii) command the at least two second legs, the second head element, the at least one second ear element, the at least one second eye element, the second mouth element, the second speaker, or the second tail element to perform an action; and

(12) a second wireless transmitter adapted to transmit the second wireless communication, the second wireless transmitter operably controlled by the second microprocessing unit.

* * * * *